US011465422B2

(12) United States Patent
Asamoto

(10) Patent No.: US 11,465,422 B2
(45) Date of Patent: Oct. 11, 2022

(54) RECORDING DEVICE

(71) Applicant: SEIKO EPSON CORPORATION, Tokyo (JP)

(72) Inventor: Katsuya Asamoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/158,064

(22) Filed: Jan. 26, 2021

(65) Prior Publication Data

US 2021/0229458 A1 Jul. 29, 2021

(30) Foreign Application Priority Data

Jan. 29, 2020 (JP) ..... JP2020-012250

(51) Int. Cl.

| | |
|---|---|
| ***B41J 11/00*** | (2006.01) |
| ***B41J 15/04*** | (2006.01) |
| ***B41J 2/475*** | (2006.01) |
| ***B41J 2/32*** | (2006.01) |
| ***B41J 29/17*** | (2006.01) |

(52) U.S. Cl.

CPC ..... *B41J 2/32* (2013.01); *B41J 11/002* (2013.01); *B41J 11/007* (2013.01); *B41J 29/17* (2013.01)

(58) Field of Classification Search

CPC . B41J 11/007; B41J 11/0024; B41J 11/00244; B41J 13/08; B41J 15/048; B41J 2/475; B41J 25/304

See application file for complete search history.

(56) References Cited

U.S. PATENT DOCUMENTS

| | | | | |
|---|---|---|---|---|
| 2016/0121624 | A1 | 5/2016 | Yamada et al. | |
| 2017/0246886 | A1 | 8/2017 | Sasaki | |
| 2018/0259887 | A1* | 9/2018 | Kikuchi | G03G 15/2032 |

FOREIGN PATENT DOCUMENTS

| | | | | |
|---|---|---|---|---|
| CN | 111216460 A | * | 6/2020 | B41J 11/002 |
| CN | 112644173 A | * | 4/2021 | B41J 11/007 |
| EP | 3403833 | | 11/2018 | |
| JP | 2016-087925 A | | 5/2016 | |
| JP | 2017-154834 A | | 9/2017 | |
| JP | 2021062485 A | * | 4/2021 | B41J 11/007 |

OTHER PUBLICATIONS

Horie (Kaneko), MachineTranslationofCN-112644173-A, 2019 (Year: 2019).*

Horie (Kaneko), MachineTranslationofJP2021062485A (from CN 112644173A), 2019 (Year: 2019).*

Ito, MachineTralsnatlionofCN-111216460-A (Year: 2019).*

* cited by examiner

*Primary Examiner* — Scott A Richmond

(74) *Attorney, Agent, or Firm* — Workman Nydegger

(57) ABSTRACT

A recording device includes a recording unit (printing unit) configured to perform recording on a medium, a transporting belt having a support face configured to support the medium, and configured to transport the medium, a heating unit configured to heat the support face, and an adjustment mechanism configured to adjust a distance between the support face and the heating unit to a first distance and to a second distance that is greater than the first distance, wherein the adjustment mechanism moves the heating unit away from the support face such that the distance is changed from the first distance to the second distance.

9 Claims, 9 Drawing Sheets

RECORDING DEVICE

The present application is based on, and claims priority from JP Application Serial Number 2020-012250, filed Jan. 29, 2020, the disclosure of which is hereby incorporated by reference herein in its entirety.

BACKGROUND

1. Technical Field

The present disclosure relates to a recording device.

2. Related Art

In the past, a recording device has been known that forms an image or the like by discharging droplets such as ink or the like onto a medium transported by a transporting belt. Some such recording devices include a printing apparatus (recording device) disclosed in JP 2017-154834 A, which heats a support face of the transporting belt before supporting the medium by irradiating the support face of the transporting belt supporting the medium with an infrared ray.

In the printing apparatus described in JP 2017-154834 A, for example, when the printing apparatus ends its operation (job), movement of the transporting belt is stopped, and heating of a heating unit is also stopped. However, an identical place of the stopped transporting belt continues to be heated by remaining heat of the heating unit. Thus, there has been a problem in that the belt is deteriorated.

SUMMARY

A recording device includes a recording unit configured to perform recording on a medium, a transporting belt having a support face configured to support the medium, and configured to transport the medium, a heating unit configured to heat the support face, and an adjustment mechanism configured to adjust a distance between the support face and the heating unit to a first distance and to a second distance that is greater than the first distance, wherein the adjustment mechanism moves the heating unit away from the support face such that the distance is changed from the first distance to the second distance.

DESCRIPTION OF EXEMPLARY EMBODIMENTS

1. First Exemplary Embodiment

A schematic configuration of a printing apparatus 100 according to a first exemplary embodiment will be described.

The printing apparatus 100 according to the present exemplary embodiment is an example as a recording device. The printing apparatus 100 is an inkjet printer that discharges ink on a medium M such as fiber to perform printing (textile printing) of a pattern or the like.

In each of the figures below, to illustrate each of members in a recognizable size, each of the members is illustrated to a scale different from an actual scale. Further, for the sake of convenience of description, an X-axis, a Y-axis, and a Z-axis are illustrated as three axes perpendicular to each other. Moreover, a direction parallel to the X-axis is referred to as an "X direction", a direction parallel to the Y-axis is referred to as a "Y direction", and a direction parallel to the Z-axis is referred to as a "Z direction". A tip side of an arrow indicating each direction is referred to as a "+ side" and a base end side is referred to as a "− side". Note that, the X direction corresponds to a width direction of the medium M described below, and the Y direction corresponds to the transport direction (horizontal direction) on a transport path of the medium M in a printing unit 30. The Z direction corresponds to a height direction, a vertical direction, and an up-and-down direction of the printing apparatus 100.

Figure 1:
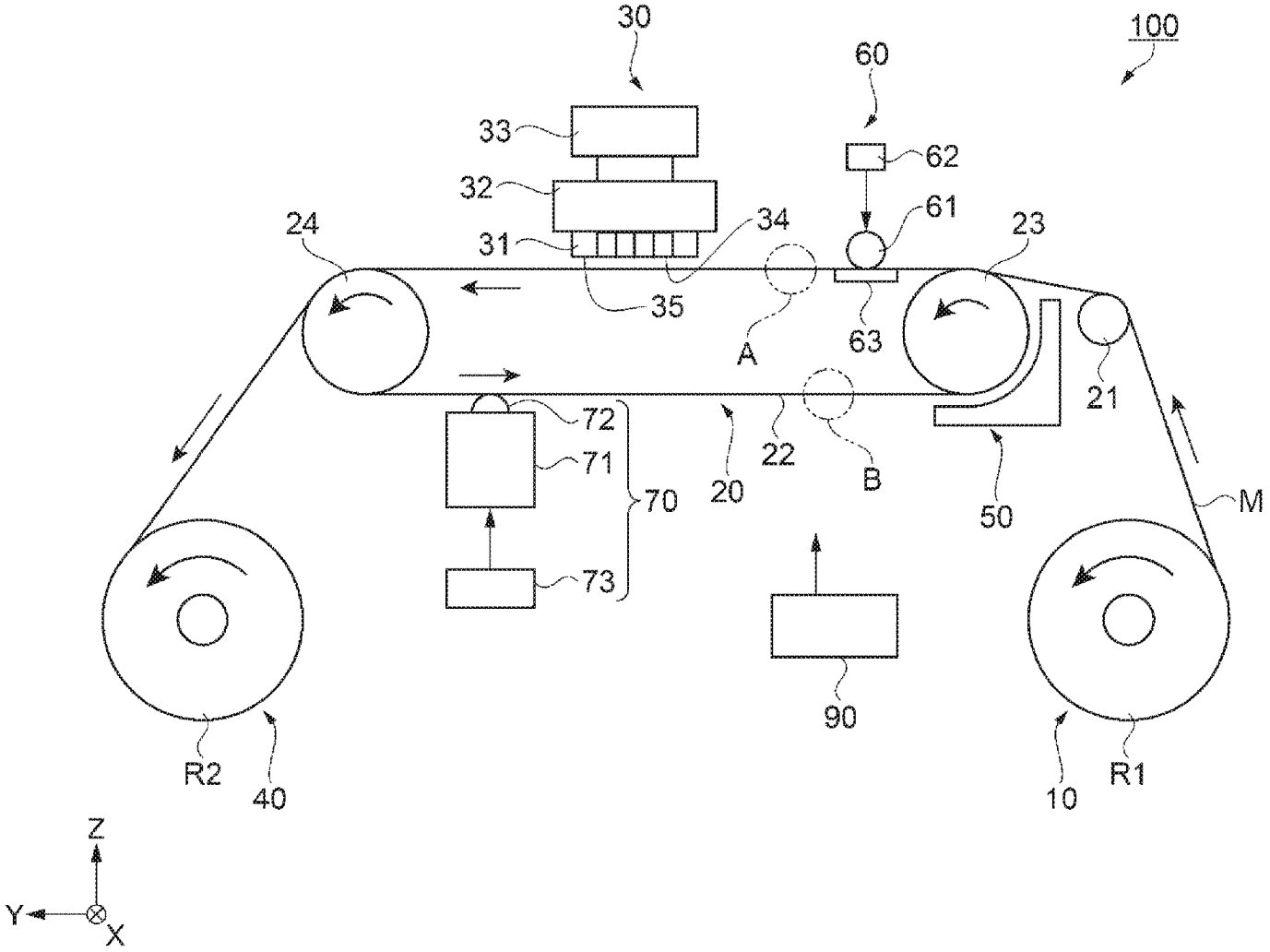
FIG. 1 is a side view illustrating a schematic configuration of a printing apparatus according to a first exemplary embodiment.

As illustrated in FIG. 1, the printing apparatus 100 includes a feeding portion 10 feeding the medium M wound in a roll shape, a transport unit 20 transporting the medium M, the printing unit 30 as a recording unit performing printing on the medium M being transported, and a winding unit 40 winding the printed medium M. The printing apparatus 100 includes a heating unit 50 heating a transporting belt 22 of the transport unit 20, a pressing unit 60 pressing the medium M against the transporting belt 22, and a cleaning unit 70 cleaning the transporting belt 22. Then, a control unit 90 controlling each of the components is provided. Note that, in the present exemplary embodiment, the medium M is fiber such as cotton, silk, wool, chemical fiber, and a blended fabric.

As illustrated in FIG. 1, the feeding portion 10 supports a roll body R1 around which the medium M is wound such that an axial direction of the roll body R1 is the X direction (width direction) of the printing apparatus 100. The feeding portion 10 rotates the roll body R1 in one direction (counterclockwise direction in FIG. 1) by a rotation driver (not illustrated) to feed out the medium M toward the transport unit 20. An operation of the rotation driver is controlled by the control unit 90.

The transport unit 20 is constituted by a transport roller 21, the transporting belt 22, a rotating roller 23, a driving roller 24, and the like. The transport roller 21 relays the medium M fed from the feeding portion 10 to the transporting belt 22.

The transporting belt 22 is constituted by an endless rubber member wound around the rotating roller 23 disposed upstream of the printing unit 30 in the transport direction and the driving roller 24 disposed downstream of the printing unit 30 in the transport direction. The transporting belt 22 is retained, with a predefined tension being acting, such that a region of the transport path described below, between the rotating roller 23 and the driving roller 24 is held horizontal.

Figure 2:
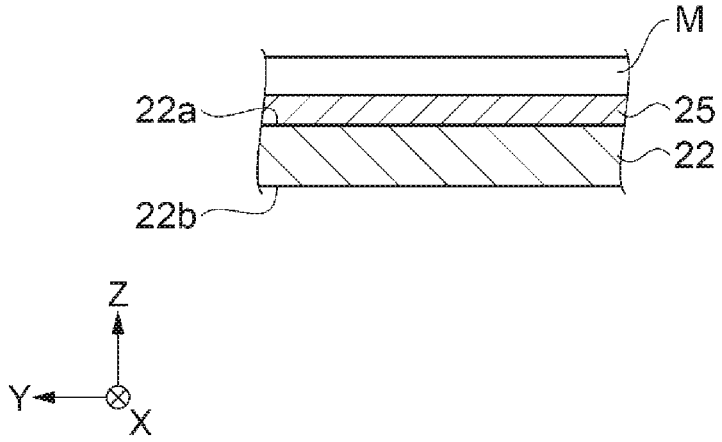
FIG. 2 is an enlarged view of a part A of a transporting belt moving along a transport path.
Figure 3:
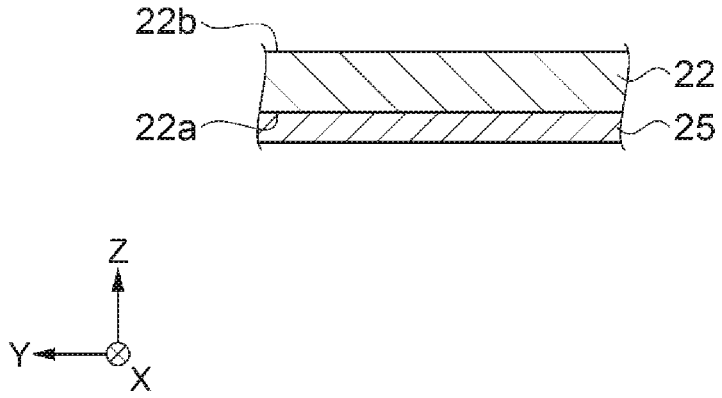
FIG. 3 is an enlarged view of a part B of the transporting belt moving along a transport preparation path.

As illustrated in FIGS. 2 and 3, an outer circumferential surface of the transporting belt 22 is a support face 22*a* that supports the medium M. The support face 22*a* is applied with an adhesive and is provided with an adhesive layer 25 to which the medium M adheres.

The transporting belt 22 supports and transports the medium M supplied from the transport unit 20, the medium M pressed against and closely adhering to the adhesive layer 25, by the pressing unit 60 described below. The transporting belt 22 is configured as a so-called glue belt, in which the adhesive is applied to the support face 22*a*. This allows stretchable clothes and the like to be handled as the medium M on which printing can be performed.

As illustrated in FIGS. 2 and 3, the rotating roller 23 and the driving roller 24 support an inner circumferential surface 22*b* of the transporting belt 22. The driving roller 24 includes a motor (not illustrated) that drives the driving roller 24 to rotate. When the driving roller 24 is driven to rotate, the transporting belt 22 rotates in association with the rotation of the driving roller 24, and the rotating roller 23 is driven to rotate in association with the rotation of the transporting belt 22.

The transporting belt 22 transports the medium M supported by the support face 22*a* in the transport direction corresponding to a +Y direction, by causing the medium M to circle in the counterclockwise direction in FIG. 1, in association with the driving of the driving roller 24. Then, the medium M is transported in the transport direction by the transporting belt 22, and an image is formed on the medium M by the printing unit 30, which will be described later.

Note that, in the present exemplary embodiment, a route along which the transporting belt 22 circles in the counterclockwise direction is referred to hereinafter as a circling path. Then, a path of the circling path along which the medium M is transported is referred to as the transport path, and a path other than that and that does not constitute the transport path of the medium M is referred to as a transport preparation path. Thus, the transport path is a path from a position where the fed medium M is pressed by the pressing unit 60 and supported by the transporting belt 22, to a position where the medium M is peeled from the transporting belt 22 after the printing is ended. The diagram illustrated in FIG. 2 illustrates a state of the transporting belt 22 moving along the transport path. Additionally, the circling path other than the transport path corresponds to the transport preparation path. FIG. 3 illustrates a state of the transporting belt 22 moving along the transport preparation path.

In the transport path, the support face 22*a* of the circling transporting belt 22 supports the medium M on a side (+Z side) opposite to the printing unit 30, and transports the medium M from a side of the rotating roller 23 to a side of the driving roller 24. In addition, in the transport preparation path, the support face 22*a* of the circling transport belt 22 faces a side (approximately −Z side) opposite to the cleaning unit 70 and the heating unit 50 described below, and only the transporting belt 22 provided with the adhesive layer 25 moves from the side of the driving roller 24 to the side of the rotating roller 23.

The winding unit 40 rotates a roll body R2 in one direction (counterclockwise direction in FIG. 1) by a rotation driver (not illustrated) such that the medium M on which an image is formed is peeled from the adhesive layer 25 of the transporting belt 22 and wound in a roll shape. The winding unit 40 supports the roll body R2 around which the medium M is wound such that a rotary shaft of the roll body R2 is parallel with the width direction (X direction). An operation of the rotation driver is controlled by the control unit 90.

The pressing unit 60 presses the medium M against the adhesive layer 25 formed at the transporting belt 22 and causes the medium M to adhere to the adhesive layer 25. In a movement direction (transport direction) of the transporting belt 22, the pressing unit 60 is provided upstream (−Y direction) of the printing unit 30, and downstream (+Y direction) of the rotating roller 23. The pressing unit 60 includes a press roller 61, a press roller driver 62, and a roller support part 63. The movement direction of the transporting belt 22 varies at each location of a circumferential surface of the transporting belt 22, and the movement direction of the transporting belt 22 near the printing unit 30 is the +Y direction. In addition, the movement direction of the transporting belt 22 may be expressed as a direction in which the transporting belt 22 is circling and moving when recording is performed on the medium M by the printing unit 30.

The press roller 61 is formed in a cylindrical shape or a columnar shape, and is rotatably provided in a circumferential direction along a cylindrical surface of the press roller 61. The press roller 61 is disposed such that a roller shaft (not illustrated) is in the width direction intersecting the transporting direction, to rotate in a direction along the transport direction. The roller support part 63 is provided on the inner circumferential surface 22*b* side of the transporting belt 22 facing the press roller 61 with the transporting belt 22 interposed between the roller support part 63 and the press roller 61.

A length in the width direction of the press roller 61 is nearly equal to a length in the width direction of the transporting belt 22. Note that, a length in the width direction of the medium M is less than a length in the width direction of each of the press roller 61 and the transporting belt 22. A length in the width direction of the roller support part 63 is nearly equal to the length in the width direction of the press roller 61.

The press roller driver 62 presses the press roller 61 in a downward direction (−Z direction). The pressed press roller 61 rotates in accordance with the movement of the transporting belt 22 in the transport direction. The medium M superimposed on the transporting belt 22 is pressed onto the transporting belt 22 between the press roller 61 and the roller support part 63 and is pressed. By the operation of the pressing unit 60, the medium M can be caused to adhere to the adhesive layer 25 formed at the support face 22*a* of the transporting belt 22, and it is possible to suppress occurrence of floating of the medium M on the transporting belt 22.

The printing unit 30 is disposed in a vertically upward direction (+Z direction) with respect to the transporting belt 22 that moves in the transport direction (+Y direction), and performs printing on the medium M supported by the support face 22*a* (adhesive layer 25) of the transporting belt 22. The printing unit 30 includes a discharge head 31, a carriage 32, a carriage moving unit 33, and the like. The discharge head 31 discharges ink as a droplet on the medium M supported by the transporting belt 22.

The discharge head 31 is provided with a nozzle plate 35 in which a plurality of nozzle rows 34 are formed. For example, four nozzle rows 34 are formed at the nozzle plate 35, and ink of different colors for each nozzle row 34 can be discharged, for example, cyan, magenta, yellow, and black. The nozzle plate 35 faces the medium M transported by the transporting belt 22.

The carriage moving unit 33 moves the discharge head 31 in the width direction (X direction) of the medium M, that corresponds to a direction intersecting the transport direction of the medium M. The carriage 32 on which the discharge head 31 is mounted is supported by a guide rail (not illustrated) disposed along the X direction, and is configured to be movable reciprocally in the X direction by the carriage moving unit 33. For a mechanism of the carriage moving unit 33, a mechanism including a combination of a ball screw and a ball nut, a linear guide mechanism, or the like may be employed.

The carriage moving unit 33 is provided with a motor (not illustrated) as a power source to move the carriage 32 along the X direction. When the motor is driven by control of the control unit 90, the discharge head 31 moves together with the carriage 32 reciprocally along the X direction. Note that, for the discharge head 31 of the present exemplary embodiment, a serial head type is used in which the discharge head 31 is mounted on the carriage 32 and discharges ink while moving in the width direction (X direction) of the medium M. Note that, the discharge head 31 may be of a line head type in which a nozzle row is provided across the width direction (X direction) of the medium M, and ink is discharged without moving the carriage 32 in the width direction (X direction).

In the printing by the printing unit 30, first the transport by the transporting belt 22 is stopped when the transported medium M comes below the predetermined nozzle row 34 of the discharge head 31, and the carriage 32 moves along the +X direction (outward path), and simultaneously the printing is performed by the discharge head 31. Next, the transporting belt 22 moves by a predetermined amount in the transport direction and is stopped. Then, the carriage 32 moves along the −X direction (return path), and simultaneously the printing is performed by the discharge head 31. Next, the transporting belt 22 moves by a predetermined amount in the transport direction and is stopped.

As described above, the printing apparatus 100 intermittently moves the transporting belt 22 to perform printing while intermittently moving the medium M adhering to the transporting belt 22. In the printing apparatus 100 of the present exemplary embodiment, the control unit 90 causes the transport unit 20 to perform the intermittent movement of the medium M, and causes the printing unit 30 to perform the operation of discharging ink, to perform printing.

After the medium M that moves along the transport path and is printed is peeled from the transporting belt 22 by the winding unit 40, the transporting belt 22 is folded back by the driving roller 24 and moves along the transport preparation path. When printing (textile printing) a pattern or the like is performed on the medium M such as fiber, ink passed through the medium M, ink running over from an end portion in the width direction of the medium M, fibers falling off from the medium M, and the like adhere to the adhesive layer 25.

The cleaning unit 70 removes ink, fibers, and the like adhering to the adhesive layer 25, by cleaning the transporting belt 22 moving along the transport preparation path with a cleaning liquid. Specifically, the cleaning unit 70 is disposed on a side of the driving roller 24 and in a downward direction (−Z direction) with respect to a position where the endless transporting belt 22 is disposed, and cleans the support face 22*a* including the adhesive layer 25 of the transporting belt 22 from below.

The cleaning unit 70 includes a cleaning vessel 71 that stores the cleaning liquid, a cleaning roller 72 immersed in the cleaning liquid and rotatably abutted against the transporting belt 22, and a movement mechanism 73 that uses an air cylinder (not illustrated) that moves the cleaning unit 70 in the up-and-down direction. In addition, the cleaning unit 70 includes a motor (not illustrated) as a power source for rotating and driving the cleaning roller 72.

The cleaning roller 72 is constituted by a rotary brush having a width that is equal to or slightly greater than a length in the width direction (X direction) of the transporting belt 22, that is substantially orthogonal to the movement direction of the transporting belt 22 (Y direction). In addition, the cleaning roller 72 has a cylindrical rotary shaft (not illustrated) extending in the width direction, and both end portions of the rotary shaft are rotatably supported by both walls each having a short side of the cleaning vessel 71 respectively.

The cleaning unit 70 configured in this manner is moved upward by the movement mechanism 73 and abuts against the support face 22*a* of the transporting belt 22 from below, which is moving along the transport preparation path. Then, the cleaning unit 70 cleans the support face 22*a* including the adhesive layer 25, by rotating the cleaning roller 72 including the cleaning liquid.

Next, the heating unit 50 will be described.

The heating unit 50 of the present exemplary embodiment heats the adhesive layer 25 formed at the support face 22*a* of the transporting belt 22 to raise a temperature thereof to a predetermined temperature (for example, 65° C.), to be softened, and to be caused to exhibit adhesiveness, and improves adhesiveness between the medium M and the adhesive layer 25. The heating unit 50 of the present exemplary embodiment heats the support face 22*a* including the adhesive layer 25 of the transporting belt 22, before the medium M is supported by the support face 22*a*. Note that, the transporting belt 22, including the adhesive layer 25, is cleaned by the cleaning unit 70 before being heated. Specifically, the heating unit 50 heats the support face 22*a* including the adhesive layer 25 before reaching the pressing unit 60 on the transport preparation path, immediately before the transport preparation path is folded back by the rotating roller 23.

A thickness of the adhesive layer 25 of the present exemplary embodiment is approximately several tens of μm. In addition, a thickness of the transporting belt 22 is approximately 2 mm to 3 mm. Thus, heating the adhesive layer 25 also heats the transporting belt 22. In the present exemplary embodiment, hereinafter, the expression "heats the support face 22*a*" or "heats the transporting belt 22" may be used when the heating unit 50 "heats the adhesive layer 25".

Figure 4:
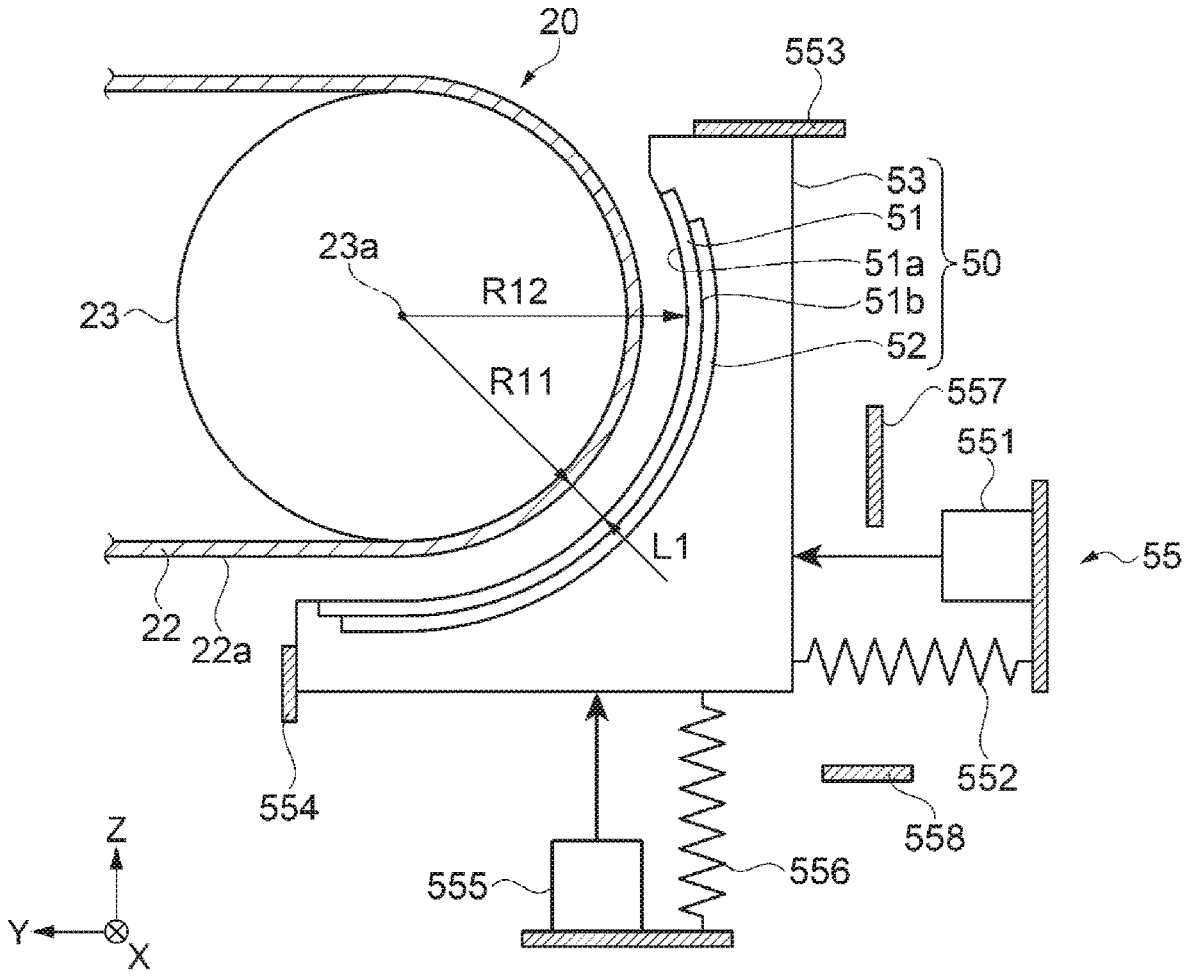
FIG. 4 is a schematic cross-sectional view illustrating a heating unit positioned at a first distance (heating position).

The printing apparatus 100 includes an adjustment mechanism 55 as illustrated in FIG. 4. The adjustment mechanism 55 is constituted by an air cylinder or the like, and according to an instruction from the control unit 90, moves the heating unit 50 away from the support face 22*a* such that a distance between the support face 22*a* and the heating unit 50 is changed from a first distance to a second distance that is greater than the first distance. The adjustment mechanism 55 also moves the heating unit 50 from the second distance to the first distance. In other words, the heating unit 50 is movable by the adjustment mechanism 55 from a heating position separated from the support face 22*a* by the first distance to a retracted position separated from the support surface 22*a* by the second distance.

Figure 6:
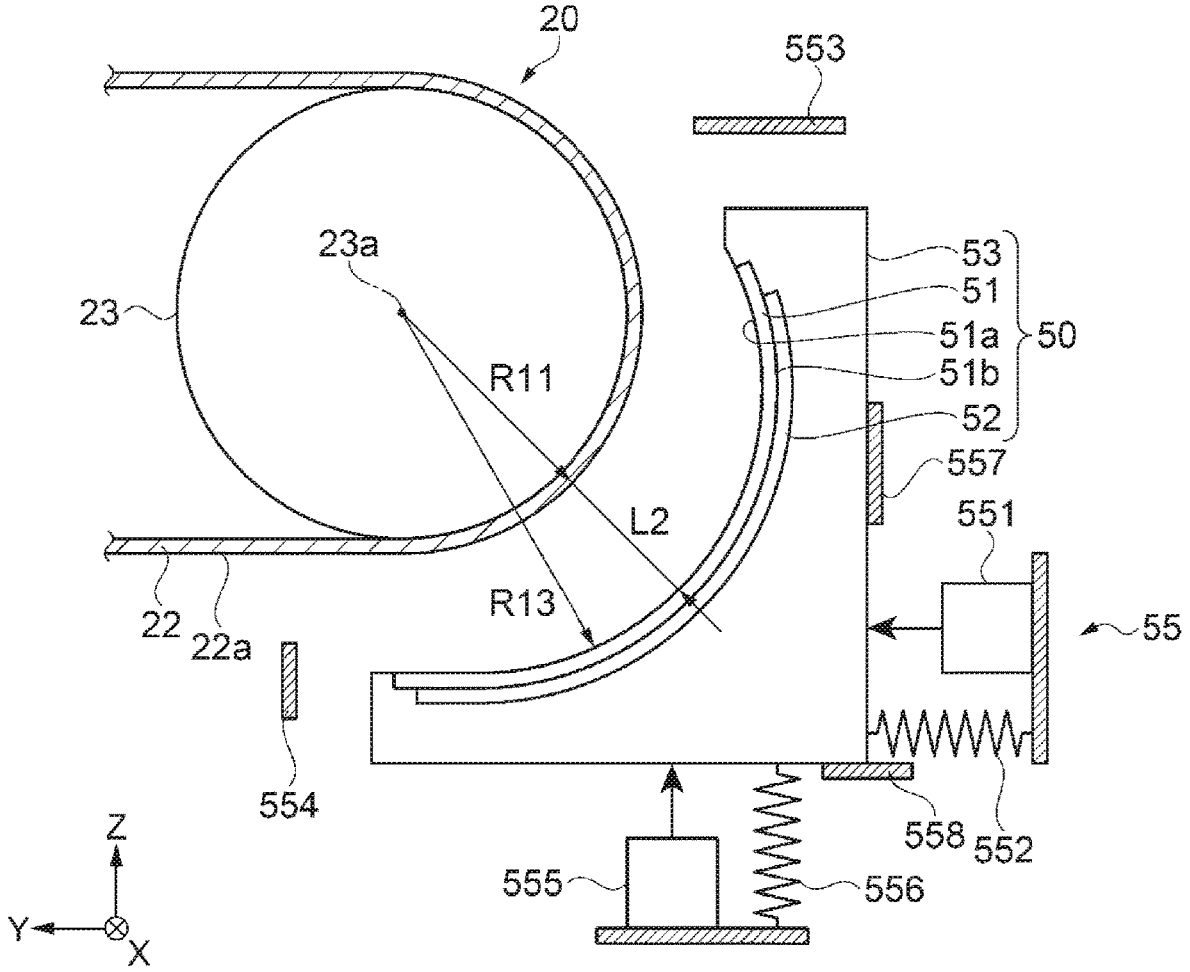
FIG. 6 is a schematic cross-sectional view illustrating the heating unit positioned at the second distance (retracted position).

Note that, the first distance is a distance when the heating unit 50 heats the transporting belt 22, and hereinafter, a position of the heating unit 50 positioned at the first distance is referred to as the heating position. Furthermore, the second distance is a distance when the heating unit 50 continues or discontinues the heating of the transporting belt 22 and retracts, and hereinafter, a position of the heating unit 50 positioned at the second distance is referred to as the retracted position. Note that, FIG. 4 illustrates a state where the heating unit 50 is positioned at the heating position, and FIG. 6 illustrates a state where the heating unit 50 is positioned at the retracted position. Note that, in the subsequent drawings of FIG. 4, illustration of the adhesive layer 25 formed at the support face 22*a* is omitted.

As illustrated in FIG. 4, the heating unit 50 includes a radiation plate 51, a sheet-like heater 52 bonded to the radiation plate 51, a heating frame 53 for fixing the radiation plate 51 and the sheet-like heater 52, and the like. As illustrated in FIG. 4, in the present exemplary embodiment, the radiation plate 51 is, with the position (heating position) when the heating unit 50 heats the transporting belt 22 (adhesive layer 25) as a reference, configured to be separated from the support face 22*a* of the transporting belt 22 supported by the rotating roller 23 by the first distance as a predetermined distance, and to include an inner circumferential surface 51*a* formed concentrically with the support face 22*a*. In this way, the radiation plate 51 is disposed so as to face the support face 22*a*. Accordingly, the heating unit 50 faces the support face 22*a*, is separated by the first distance, and heats the support face 22*a* in a non-contact manner.

As illustrated in FIG. 4, the first distance is a difference between R12 and R11 at the heating position, where a distance from a center line 23*a* of the rotating roller 23 to the support face 22*a* of the transporting belt 22 is R11, and a shortest distance from the center line 23*a* to the inner circumferential surface 51*a* of the radiation plate 51 is R12. In the present exemplary embodiment, as illustrated in FIG. 4, when the first distance is L1, L1 is approximately 5 mm. Accordingly, the heating unit 50 is separated from the support face 22*a* by the first distance. As illustrated in FIG. 6, the second distance is a difference between R13 and R11 at the retracted position, where the distance from the center line 23*a* of the rotating roller 23 to the support face 22*a* of the transporting belt 22 is R11, and a shortest distance from the center line 23*a* to the inner circumferential surface 51*a* of the radiation plate 51 is R13. Additionally, as illustrated in FIG. 6, when the second distance is L2, L2 is approximately 10 cm.

Note that, when the transporting belt 22 is of a type where the medium M is directly adsorbed by the transporting belt 22, such as electrostatic adsorption, the support face 22*a* is an outer circumferential surface of the transporting belt 22. In addition, when the transporting belt 22 is of a type where the medium M is indirectly adsorbed by the transporting belt 22 via an adhesive layer, and a size of each of the first distance L1 and the second distance L2 may be designed considering that the support face 22*a* is an outermost surface of the adhesive layer. Thus, the size of each of the first distance L1 and the second distance L2 can be set to fall within a range with which overheating of the adhesive layer is suppressed.

Note that, when the first distance is L1, the first distance L1 is a shortest distance between the support face 22*a* and the radiation plate 51 when the heating unit 50 is positioned at the heating position. Additionally, when the second distance is L2, the second distance L2 is a shortest distance between the support face 22*a* and the radiation plate 51 when the heating unit 50 is positioned at the retracted position. Hereinafter, the first distance is used as the first distance L1 and the second distance is used as the second distance L2.

The radiation plate 51 is configured such that the inner circumferential surface 51*a* extends along the width direction of the transporting belt 22. A length in the width direction of the radiation plate 51 is configured such that a length between both end positions is slightly longer with respect to the length in the width direction of the transporting belt 22. The radiation plate 51 has a curved portion facing a portion of the transporting belt 22, that is wound around the rotating roller 23, and a planar portion connected to the curved portion, and facing a portion of the transporting belt 22, that is not wound around the rotating roller 23. Since the radiation plate 51 has the curved portion, heating efficiency of the portion of the transporting belt 22, that is wound around the rotating roller 23 is improved.

When viewed in cross section, as illustrated in FIG. 4, in the radiation plate 51, a length of the inner circumferential surface 51*a* corresponds to a range equal to or greater than a region from a vertically downward position to a horizontal position in the transporting belt 22 supported by the rotating roller 23. In the present exemplary embodiment, in the radiation plate 51, a plate member of aluminum is curved and used.

The sheet-like heater 52 heats the radiation plate 51 such that radiant heat is emitted from the radiation plate 51. The sheet-like heater 52 is configured by sandwiching a heating element such as a metal foil inside a sheet member such as a flexible synthetic resin, and generates heat such that temperature distribution of the sheet-like heater 52 is substantially uniform. The sheet-like heater 52 is disposed by being bonded over substantially an entire outer circumferential surface 51*b* of the radiation plate 51. The heating frame 53 fixes the radiation plate 51 in a state where the inner circumferential surface 51*a* of the radiation plate 51 to which the sheet-like heater 52 is bonded is exposed to a side of the support face 22*a*.

When power is supplied to the metal foil of the sheet-like heater 52, heat is generated in the metal foil, and the heat is transferred through the sheet member to the radiation plate 51. The radiation plate 51 is heated since the heat from the sheet-like heater 52 is transferred thereto. The heated radiation plate 51 emits radiant heat toward the transporting belt 22 opposed thereto. In the present exemplary embodiment, by using the radiation plate 51, temperature unevenness can be reduced and the support face 22*a* can be uniformly heated.

As described above, the adjustment mechanism 55 moves the heating unit 50 to the heating position and the retracted position. Specifically, the adjustment mechanism 55, when recording processing (printing processing) described below ends and the transporting belt 22 is stopped, in accordance with an instruction from the control unit 90, performs an operation for moving the heating unit 50 away from the support face 22*a*, such that the distance between the support face 22*a* and the heating unit 50 changes from the first distance L1 to the second distance L2. By performing this operation, the adjustment mechanism 55 attenuates an amount of heat at the support face 22*a*, even when a place of the transporting belt 22 opposed to the heating unit 50 continues to be heated when the transporting belt 22 is stopped.

Note that, normally, when the power supply to the sheet-like heater 52 is stopped by an instruction from the control unit 90, the heating unit 50 cannot instantaneously set the radiant heat emitted from the radiation plate 51 to "0", and gradually lowers the amount of heat while releasing the radiant heat. This is because the radiation plate 51 or the sheet-like heater 52 has a finite sized heat capacity. Thus, when the transporting belt 22 is stopped, a region of the transporting belt 22, that is opposed to the heating unit 50, continues to be heated.

In this case, the transporting belt 22 is in a state of being overheated and a heat resistance temperature of the transporting belt 22 may be exceeded. Thus, the adjustment mechanism 55 of the present exemplary embodiment moves (retracts) the heating unit 50 away from the support face 22*a* of the transporting belt 22, when the transporting belt 22 is stopped such that the heat resistance temperature of the transporting belt 22 is not exceeded, thereby reducing an effect of the release of radiant heat on the stopped transporting belt 22.

When a condition is met, the control unit 90 causes the heating unit 50 to move away from the support face 22*a* such that the first distance L1 is changed to the second distance L2. In other words, when the condition is met, the control unit 90 causes the adjustment mechanism 55 to drive to move the heating unit 50 from the heating position to the retracted position.

Here, the condition in the present exemplary embodiment includes ending of the recording processing (printing processing) by the printing unit 30. Specifically, when the intermittent movement of the medium M by the transport unit 20 and the operation of discharging ink by the printing unit 30 are repeated alternately to perform printing, processing including the intermittent movement and the operation of discharging is the printing processing. Thus, when the printing processing including the intermittent movement and the operation of discharging ends, the condition is met.

Furthermore, the case where the condition in the present exemplary embodiment is satisfied includes a case where a signal for temporarily stopping in the middle of printing is inputted and the transporting belt 22 is temporarily stopped, or a case where the medium M being transported is peeled or the like and the medium M is clogged in the apparatus, thus the transporting belt 22 is stopped (a so-called jam occurs), and the like. Also included is a case where detected values by a temperature sensor and other sensors installed inside the apparatus, including a temperature sensor (not illustrated) for detecting a temperature of the transporting belt 22, are abnormal values, and the like. In any case, the case where the condition in the present exemplary embodiment is met does not include intermittent stopping during intermittent movement during printing, and is a case where the transporting belt 22 needs to be stopped, and the condition refers to a cause of stopping the transporting belt 22.

A configuration of the adjustment mechanism 55 will be described.

The adjustment mechanism 55 includes a first air cylinder 551, a first tension spring 552, a first guide portion 553, and a first stopper 554, and moves the heating unit 50 in the Y direction. The adjustment mechanism 55 includes a second air cylinder 555, a second tension spring 556, a second guide portion 557, and a second stopper 558, and moves the heating unit 50 in the Z direction. Note that, the adjustment mechanism 55 moves the heating unit 50 to a position where mutual operations among respective components change the distance between the support face 22*a* and the heating unit 50 to the first distance L1 (heating position) or to the second distance L2 (retracted position).

A state of the adjustment mechanism 55 when the heating unit 50 is at the heating position (when the heating unit 50 is at the first distance L1) will be described.

As illustrated in FIG. 4, the adjustment mechanism 55 is in a state where the first air cylinder 551 expands a rod to press the heating unit 50 in the +Y direction. In this state, the first tension spring 552 is in a state of extending in the +Y direction in a state of opposing to tensile force. Further, after moving in the +Y direction along the first guide portion 553, the heating unit 50 is in a state of abutting on the first stopper 554 and stopped from moving.

At this time, the second air cylinder 555 and the second tension spring 556 move in accordance with the movement of the heating unit 50. Additionally, the second air cylinder 555 is in a state of expanding a rod to press the heating unit 50 in the +Z direction and causing the heating unit 50 to abut on the first guide portion 553. The second tension spring 556 is in a state of extending in the +Z direction in a state of opposing to tensile force.

Here, a procedure will be described for moving the heating unit 50 from the heating position (first distance L1) to the retracted position (second distance L2) by the adjustment mechanism 55, when the recording processing (printing processing) ends.

When the recording processing (printing processing) ends, the control unit 90 causes the transporting belt 22 to stop. Then, the control unit 90 instructs the adjustment mechanism 55 to move the heating unit 50 from the heating position to the retracted position.

Note that, in the present exemplary embodiment, when the heating unit 50 is moved from the heating position to the retracted position, the movement is performed in two steps. This is because movement constraints are generated due to a gap relationship between a size of the heating unit 50 depending on a shape thereof, and a structure around the heating unit 50 in a housing of the printing apparatus 100. In the present exemplary embodiment, the two movements are performed in order to solve the aforementioned constraints including that there are problems such as the heating unit 50 abutting on the transporting belt 22 when movement is performed in one step. In addition, the two movements are performed as linear movements.

Figure 5:
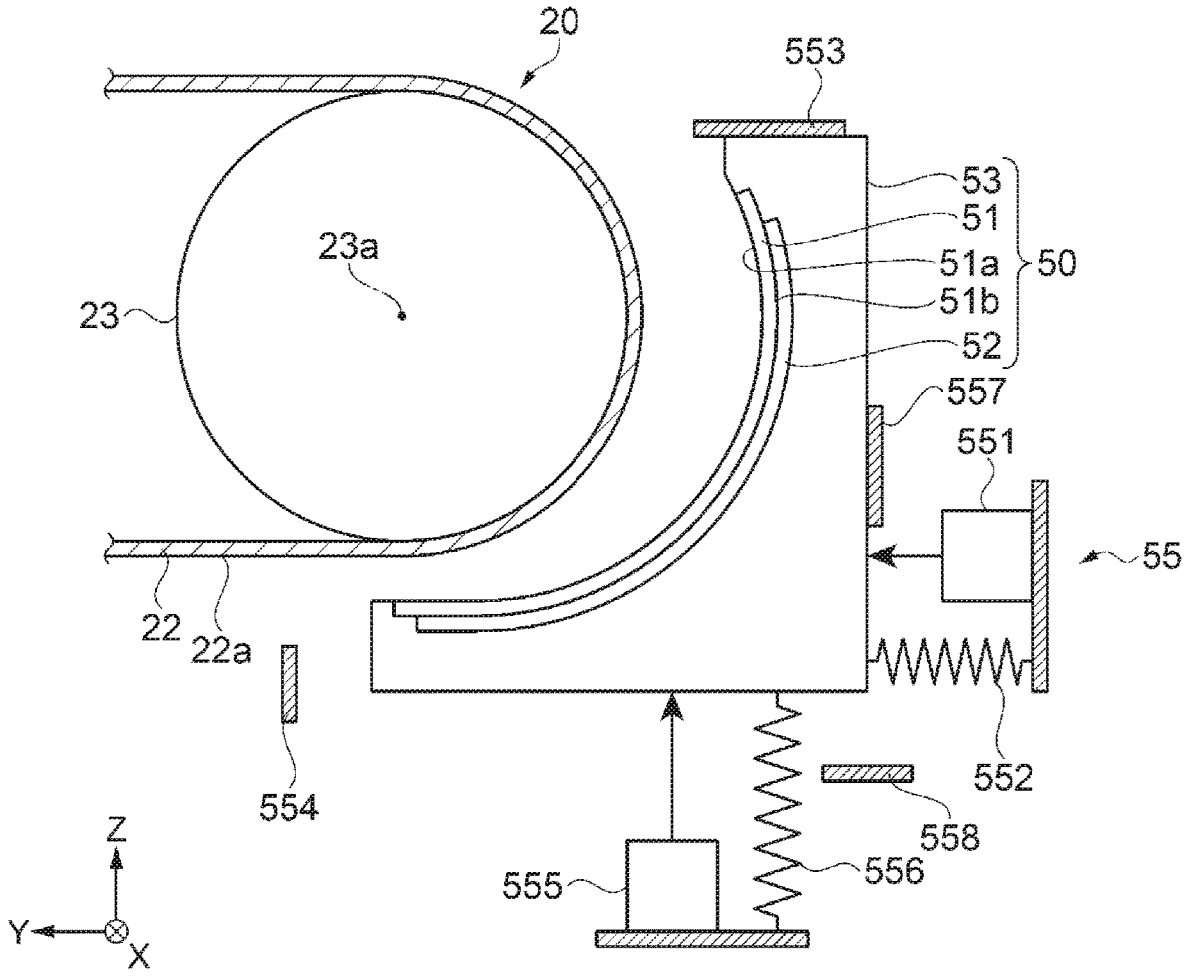
FIG. 5 is a schematic cross-sectional view illustrating the heating unit during moving to a second distance (retracted position).

First, upon receiving an instruction from the control unit 90, the adjustment mechanism 55 moves the heating unit 50 in the −Y direction. In this case, as illustrated in FIG. 5, the first air cylinder 551 stops the pressing operation, and the rod returns to its original position. Thus, the first tension spring 552 also returns to its original state, and thus, an operation is performed for pulling the heating unit 50 in the −Y direction by tensile force of the first tension spring 552. According to this operation, the heating unit 50 moves in the −Y direction along the first guide portion 553, abuts on the second guide portion 557, and is stopped from moving. At this time, the second air cylinder 555 and the second tension spring 556 maintain the state at the heating position, and move in accordance with the movement of the heating unit 50.

Next, the adjustment mechanism 55 moves the heating unit 50 in the −Z direction. In this case, as illustrated in FIG. 6, the second air cylinder 555 stops the pressing operation, and the rod returns to its original position. Thus, the second tension spring 556 also returns to its original state, and thus, an operation is performed for pulling the heating unit 50 in the −Z direction by tensile force of the second tension spring 556. According to this operation, the heating unit 50 moves in the −Z direction along the second guide portion 557, abuts on the second stopper 558, and is stopped from moving, and thus can move to the retracted position, corresponding to the second distance L2. At this time, the first air cylinder 551 and the first tension spring 552 maintain the state at the position after moving in the −Y direction from the heating position, and moves in accordance with the movement of the heating unit 50.

As described above, the adjustment mechanism 55 moves the heating unit 50 from the heating position to the retracted position.

When starting the printing processing by the printing unit 30, the control unit 90 instructs the adjustment mechanism 55 to move the heating unit 50 such that the heating unit 50 approaches the support face 22*a* so as to move from the retracted position (second distance L2) to the heating position (the first distance L1). Note that, when the printing processing by the printing unit 30 is printing processing performed first in multiple times of printing processing, the heating unit 50 may be positioned at the heating position at the time when the printing processing is started.

In the present exemplary embodiment, when the printing processing is started, it is necessary to heat the support face 22*a* (adhesive layer 25) of the transporting belt 22, and to cause the medium M being transported to adhere to the adhesive layer 25 by the pressing unit 60. Thus, in the present exemplary embodiment, the heating unit 50 is heated in advance at the retracted position before the heating unit 50 is moved. In addition, in the present exemplary embodiment, the heating unit 50 is driven at the same time that the printing processing is started. Then, when the radiation plate 51 reaches a predetermined temperature (for example, 200° C.) due to the heating by the heating unit 50 at the retracted position, the adjustment mechanism 55 moves the heating unit 50 from the retracted position to the heating position. Note that, after the heating unit 50 is moved to the heating position by the adjustment mechanism 55, the heating unit 50 heats the support face 22*a* of the moving transporting belt 22. Then, the transporting belt 22 starts moving, and the printing unit 30 starts printing.

Here, a procedure will be described for the movement of the heating unit 50 by the adjustment mechanism 55, when the recording processing (printing processing) is started, and after the heating unit 50 is heated, from the heating position (first distance L1) to the retracted position (second distance L2). Note that, the movement of the heating unit 50 from the retracted position to the heating position by the adjustment mechanism 55 is performed by a reverse procedure of the movement procedure from the heating position to the retracted position.

When the heating unit 50 is moved from the retracted position to the heating position, the movement is performed in two steps. As illustrated in FIG. 6, when the heating unit 50 is positioned at the retracted position, the heating unit 50 is initially moved in the +Z direction and moved to the position illustrated in FIG. 5, and then the heating unit 50 is moved in the +Y direction and moved to the position of the heating unit 50 illustrated in FIG. 4.

The adjustment mechanism 55 causes the second air cylinder 555 to press the heating unit 50 in the +Z direction, and causes the heating unit 50 to move in the +Z direction along the second guide portion 557, and to abut on the first guide portion 553. Note that, the second tension spring 556 extends in the +Z direction in a state of opposing to the tensile force. At this time, the first air cylinder 551 and the first tension spring 552 maintain the state at the retracted position, and move in accordance with the movement of the heating unit 50.

Next, the adjustment mechanism 55 causes the first air cylinder 551 to press the heating unit 50 in the +Y direction, and causes the heating unit 50 to move in the +Y direction along the first guide portion 553, and to abut on the first stopper 554. Note that, the first tension spring 552 extends in the +Y direction in a state of opposing to the tensile force. At this time, the second air cylinder 555 and the second tension spring 556 maintain the state at the position after moving in the +Z direction from the retracted position, and moves in accordance with the movement of the heating unit 50.

According to the above-described operation, the adjustment mechanism 55 moves the heating unit 50 from the retracted position to the heating position.

According to the present exemplary embodiment, the following advantages can be obtained.

The printing apparatus 100 of the present exemplary embodiment includes the printing unit 30 configured to perform printing on the medium M, the transporting belt 22 having the support face 22*a* configured to support the medium M, and configured to transport the medium M, the heating unit 50 configured to heat the support face 22*a*, and the adjustment mechanism 55 configured to adjust the distance between the support face 22*a* and the heating unit 50 to the first distance L1 and the second distance L2 that is greater than the first distance L1. The adjustment mechanism 55 moves the heating unit 50 away from the support face 22*a* such that the distance is changed from the first distance L1 to the second distance L2. Thus, when the transporting belt 22 is stopped and an identical place on the support face 22*a* is brought into a state of being continuously heated by the heating unit 50, by changing the distance between the support face 22*a* and the heating unit 50 from the first distance L1 to the second distance L2, an amount of heat energy applied to the support face 22*a* is attenuated, and thus overheating of the transporting belt 22 can be prevented, and deterioration of the transporting belt 22 can be suppressed.

The printing apparatus 100 of the present exemplary embodiment includes the control unit 90 controlling the adjustment mechanism 55. Then, when the condition is met, the control unit 90 controls the adjustment mechanism 55 to move the heating unit 50 away from the support face 22*a* such that the distance is changed from the first distance L1 to the second distance L2.

According to the configuration described above, since the control unit 90 is provided, for example, as a case where the condition is met, for example, after the printing processing ends and the transporting belt 22 is stopped, the operation of moving the heating unit 50 with respect to the support face 22*a* can be automated, and convenience of a user can be improved.

In the printing apparatus 100 of the present exemplary embodiment, the transporting belt 22 is the glue belt having the adhesive layer 25 obtained by applying the adhesive to the support face 22*a*, and the heating unit 50 faces the support face 22*a* and heats the support face 22*a* in a non-contact manner.

According to the configuration described above, when the transporting belt 22 is the glue belt, the heating unit 50 may contact the glue and the glue may be damaged depending on a place that is heated. However, according to the above-described configuration, even in such a case, the heating unit 50 can heat the support face 22*a* in a non-contact manner, thus the glue is less likely to be damaged. In addition, since the heating unit 50 faces the support face 22*a*, heat energy from the heating unit 50 is efficiently transferred to the support face 22*a*, and deterioration in heating efficiency due to a heat transfer rate of the transporting belt 22 and the like can be suppressed, compared to a mechanism that heats from an opposite side of the support face 22*a*.

The printing apparatus 100 of the present exemplary embodiment includes the cleaning unit 70 that cleans the support face 22*a* with the cleaning liquid, and the heating unit 50 heats the support face 22*a* cleaned by the cleaning unit 70 at the first distance L1, before the medium M is supported.

According to the configuration described above, by cleaning the support face 22*a* by the cleaning unit 70, it is possible to remove ink passed through the medium M, ink running over from an end portion in the width direction of the medium M, fibers falling off from the medium M, and the like that adhere to the support face 22*a*.

In the printing apparatus 100 according to the present exemplary embodiment, the condition includes ending of the printing processing by the printing unit 30.

According to the configuration described above, the heating unit 50 can be moved (retracted) away from the support face 22*a* in accordance with the ending of the printing processing such that the first distance L1 is changed to the second distance L2. This eliminates a need for the user him/herself to retract the heating unit 50 away from the support face 22*a*, which makes it possible to improve the convenience.

In the printing apparatus 100 of the present exemplary embodiment, when the printing processing by the printing unit 30 is started, the control unit 90 causes the heating unit 50 to move toward the support face 22*a* such that the distance is changed from the second distance L2 to the first distance L1.

According to the configuration described above, the heating unit 50 can again be brought closer to the support face 22*a* in accordance with restarting of the printing processing. This eliminates a need for the user him/herself to bring the heating unit 50 closer to the support face 22*a*, which makes it possible to improve the convenience.

When the printing processing is started, the control unit 90 drives the heating unit 50 and, after the heating unit 50 reaches the predetermined temperature, causes the heating unit 50 to move such that the second distance L2 is changed to the first distance L1.

According to the above-described configuration, compared to a case where the heating unit 50 is heated after being moved to the first distance L1, by causing the heating unit 50 to move to the first distance L1 after the heating unit 50 reaches the predetermined temperature, and the temperature is stable, a heating time for which a heat capacity of the transporting belt 22 is taken into consideration, and the like can be controlled, and accurate temperature control can be performed.

In the printing apparatus 100 of the present exemplary embodiment, the heating unit 50 includes the radiation plate 51, and the radiation plate 51 is disposed so as to face the support face 22*a*.

According to the configuration described above, the support face 22*a* can be uniformly heated by the radiation plate 51.

In the printing apparatus 100 of the present exemplary embodiment, the radiation plate 51 includes the plate member of aluminum.

According to the configuration described above, the support face 22*a* can be efficiently heated by providing the plate member of aluminum having a high heat transfer rate (high heat dissipation efficiency) as the radiation plate 51. Further, even when the transporting belt 22 is stopped, the power supplied to the sheet-like heater 52 is stopped, and the heating unit 50 is moved from the first distance L1 to the second distance L2, cooling efficiency of the heating unit 50 can be improved.

2. Second Exemplary Embodiment

A method for moving the heating unit 50 of a printing apparatus 100A according to a second exemplary embodiment will be described with reference to FIG. 7.

In the printing apparatus 100A of the present exemplary embodiment, when compared to the printing apparatus 100 of the first exemplary embodiment, a configuration of an adjustment mechanism 56 is different from the configuration of the adjustment mechanism 55 of the first exemplary embodiment. The other components are similar to those in the first exemplary embodiment. Additionally, operation of the heating unit 50 and the like are also similar to the operation of the heating unit 50 of the first exemplary embodiment. A similar configuration to that in the first exemplary embodiment will be given a similar reference numeral and duplicate description will be omitted.

The adjustment mechanism 56 of the present exemplary embodiment includes a first air cylinder 561, a first tension spring 562, a first stopper 563, a second stopper 564, and a hinge portion 565, and rotates the heating unit 50 about the hinge portion 565. Note that, the adjustment mechanism 56 moves (rotates) the heating unit 50 to a position at the first distance L1 (heating position) and a position at the second distance L2 (retracted position).

A state of the adjustment mechanism 56 when the heating unit 50 is at the heating position (when the heating unit 50 is at the first distance L1) will be described.

Figure 7:
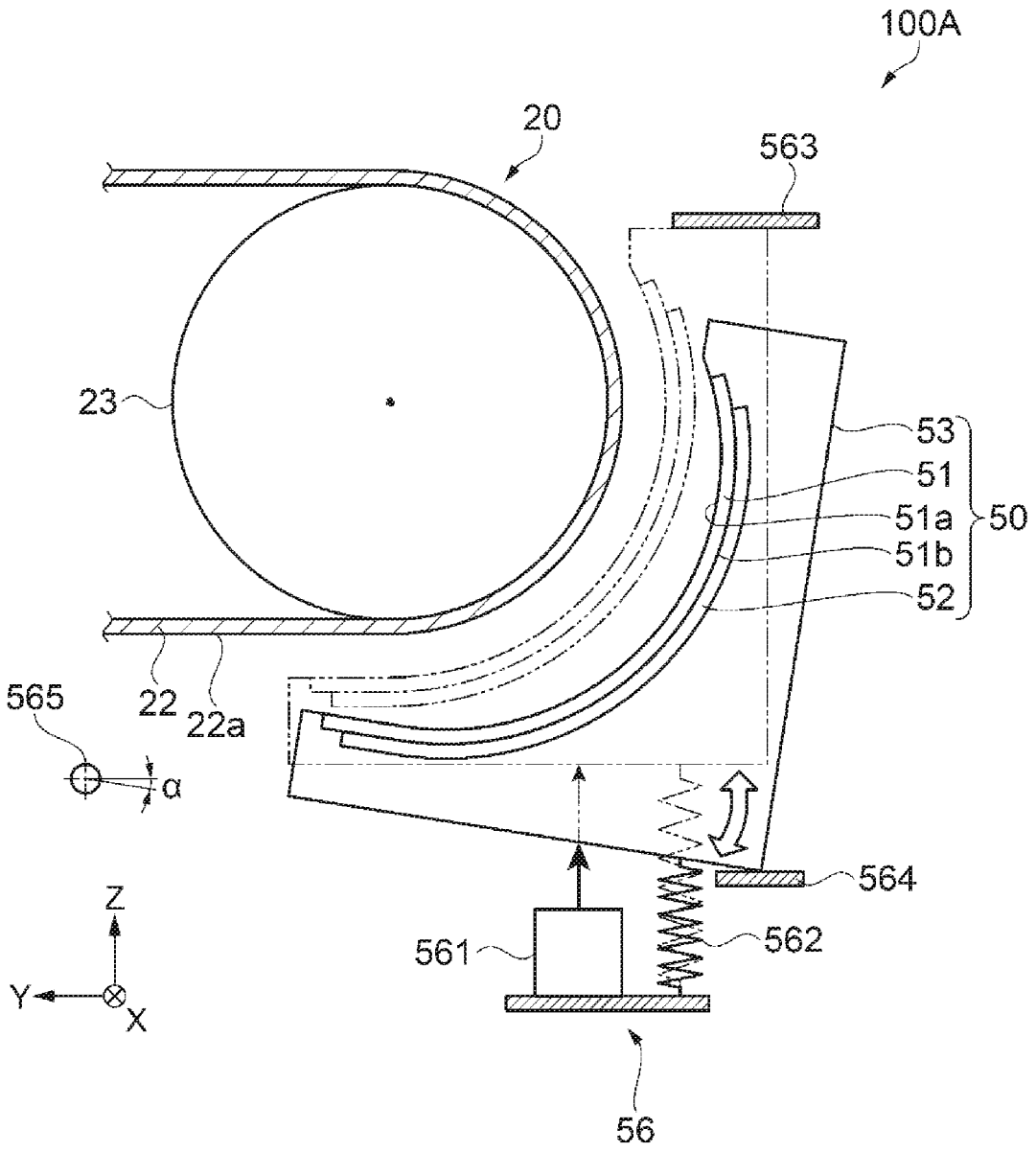
FIG. 7 is a schematic cross-sectional view illustrating a method for moving a heating unit of a printing apparatus according to a second exemplary embodiment.

As illustrated by a long dashed double-short dashed line in FIG. 7, the adjustment mechanism 56 is in a state where the first air cylinder 561 expands a rod and presses the heating unit 50 in the +Z direction. Then, when the first air cylinder 561 presses the heating unit 50 in the +Z direction, the heating unit 50 is brought into a state of rotating counterclockwise about the hinge portion 565 by an angle $\alpha$ and abutting on the first stopper 563. In this state, the first tension spring 562 is in a state of extending in the +Z direction in a state of opposing to tensile force.

Next, a procedure will be described for moving the heating unit 50 from the heating position (first distance L1) to the retracted position (second distance L2) by the adjustment mechanism 56, when the recording processing (printing processing) ends.

When the adjustment mechanism 56 receives an instruction from the control unit 90, as indicated by a solid line in FIG. 7, the first air cylinder 561 stops the pressing operation and the rod returns to its original position. Thus, the first tension spring 562 also returns to its original state, and thus, an operation is performed for pulling the heating unit 50 in the −Z direction by tensile force of the first tension spring 562. With this operation, the heating unit 50 is brought into a state of rotating clockwise about the hinge portion 565 by the angle $\alpha$ and abutting on the second stopper 564.

With the operation described above, the heating unit 50 moves to the retracted position (second distance L2).

According to the present exemplary embodiment, similar effects to the effects in the first exemplary embodiment can be achieved.

Note that, in the first exemplary embodiment, the heating unit 50 is linearly moved, but unlike this, as in the present exemplary embodiment, the heating unit 50 may be moved to the first distance L1 and the second distance L2 by rotating and moving the heating unit 50. Thus, a degree of freedom of movement of the heating unit 50 between the first distance L1 and the second distance L2 is improved.

3. Third Exemplary Embodiment

A schematic configuration of a heating unit 50B of a printing apparatus 100B according to a third exemplary embodiment will be described with reference to FIG. 8.

In the printing apparatus 100B of the present exemplary embodiment, when compared to the printing apparatus 100 of the first exemplary embodiment, a configuration of the heating unit 50B is different from the configuration of the heating unit 50 of the first exemplary embodiment. The other components are similar to those in the first exemplary embodiment. Additionally, operation of the heating unit 50B and the like are also similar to the operation of the heating unit 50 of the first exemplary embodiment. A similar configuration to that in the first exemplary embodiment will be given a similar reference numeral and duplicate description will be omitted.

Figure 8:
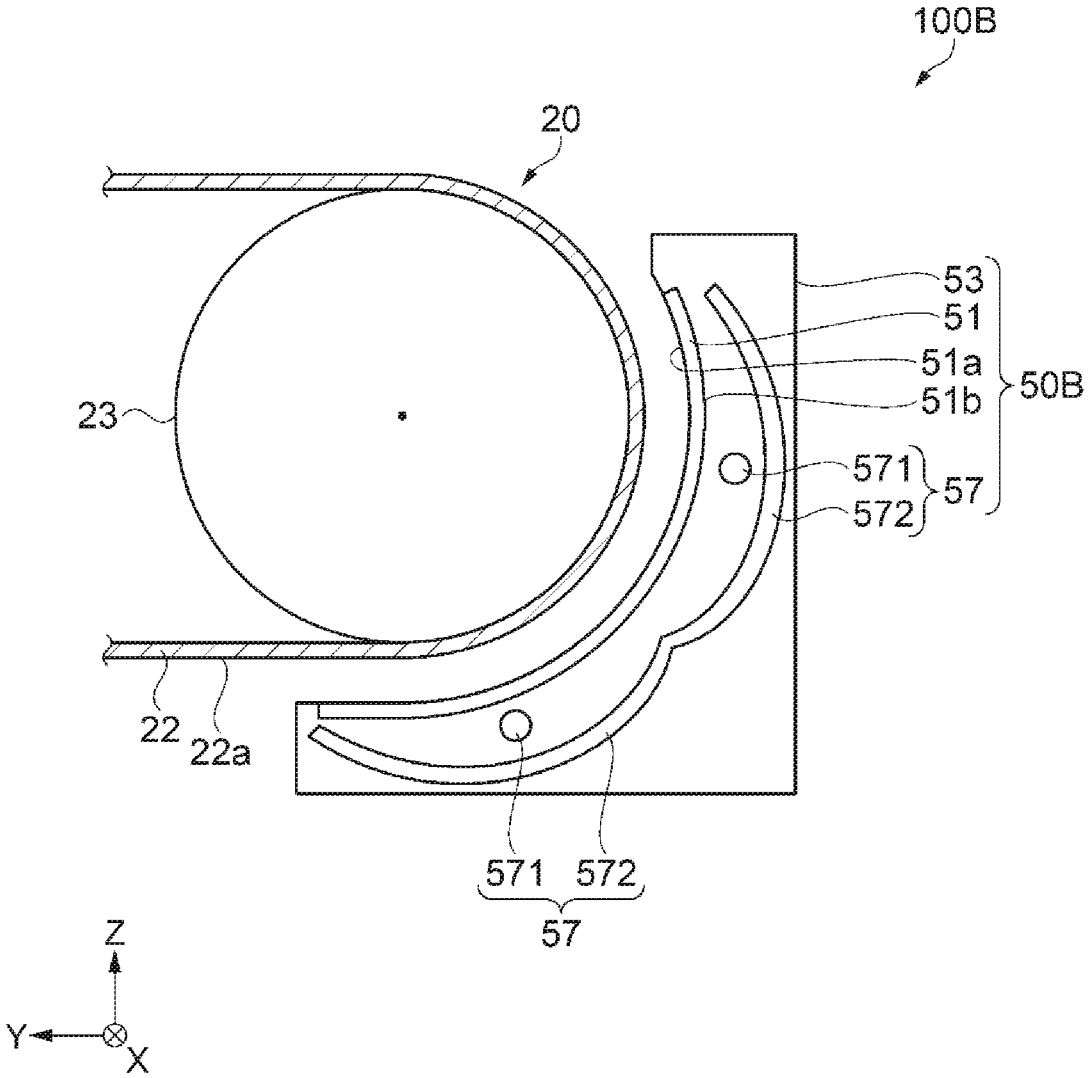
FIG. 8 is a schematic cross-sectional view illustrating a heating unit of a printing apparatus according to a third exemplary embodiment.

As illustrated in FIG. 8, the heating unit 50B of the present exemplary embodiment includes two heaters 57 in place of the sheet-like heater 52 of the first exemplary embodiment. The heating unit 50B further includes the radiation plate 51 and the heating frame 53 similar to those of the first exemplary embodiment.

The heater 57 is constituted by an irradiation unit 571, a reflecting plate 572, and the like. The irradiation unit 571 is formed in a tubular shape and extends in a width direction, and is formed to have a length similar to a length in the width direction of the transporting belt 22. Additionally, the reflecting plate 572 has a curved cross-sectional shape illustrated in FIG. 8, extends in the width direction, and is formed to have a length similar to a length in the width direction of the irradiation unit 571. Note that, the irradiation unit 571 of the present exemplary embodiment is constituted by an infrared heater, and emits infrared rays as electromagnetic waves.

The heater 57 is disposed to irradiate the outer circumferential surface 51*b* of the radiation plate 51 with reflected light by the reflecting plate 572, in addition to direct light from the irradiation unit 571. Thus, the radiation plate 51 is heated and emits radiant heat toward the support face 22*a*.

According to the present exemplary embodiment, similar effects to the effects in the first exemplary embodiment can be achieved.

4. Fourth Exemplary Embodiment

A schematic configuration of a heating unit 50C of a printing apparatus 100C according to a fourth exemplary embodiment will be described with reference to FIG. 9.

In the printing apparatus 100C of the present exemplary embodiment, when compared to the printing apparatus 100B of the third exemplary embodiment, a configuration of the heating unit 50C is different from the configuration of the heating unit 50B of the third exemplary embodiment. In addition, in the third exemplary embodiment, the heating unit 50B moves linearly from the first distance L1 to the second distance L2, as in the case of the first embodiment, but the heating unit 50C of the present exemplary embodiment is different in that the heating unit 50C performs rotational movement as in the case of the heating unit 50 of the second exemplary embodiment. The other components are similar to those in the third exemplary embodiment. A similar configuration to that in the third exemplary embodiment will be given a similar reference numeral and duplicate description will be omitted.

Figure 9:
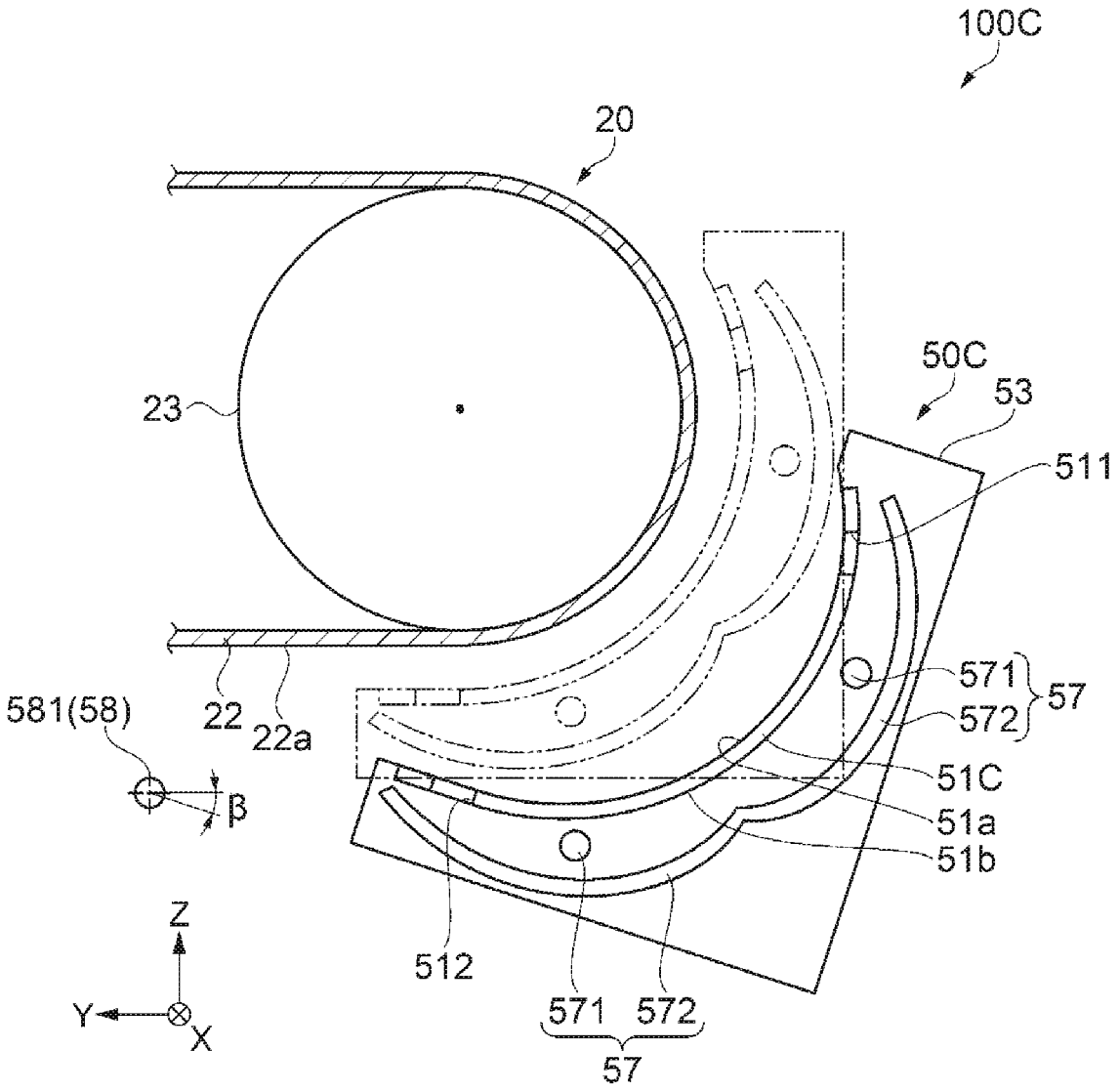
FIG. 9 is a schematic cross-sectional view illustrating a heating unit of a printing apparatus according to a fourth exemplary embodiment.

As illustrated in FIG. 9, a configuration of a radiation plate 51C of the heating unit 50C is different from the configuration of the radiation plate 51 of the heating unit 50B of the third exemplary embodiment. Holes are formed in rows in the radiation plate 51C of the present exemplary embodiment. Specifically, as illustrated in FIG. 9, a plurality of first opening portions 511 and second opening portions 512 are formed at a predetermined pitch in a width direction. Further, the heating unit 50C includes an adjustment mechanism 58 configured substantially similarly to the adjustment mechanism 56 of the second exemplary embodiment as for movement between the first distance L1 and the second distance L2, and moves while rotating in the clockwise direction and the counterclockwise direction by an angle β about a hinge portion 581. Details are similar to the adjustment mechanism 56 in the second exemplary embodiment, and thus descriptions thereof will be omitted.

At the first distance L1 (heating position), as illustrated by a long dashed double-short dashed line in FIG. 9, by directly irradiating the support face 22*a* with reflected light by the reflecting plate 572 of the heater 57, via the first opening portion 511 and the second opening portion 512 of the radiation plate 51C, the heating unit 50C can quickly raise a temperature of the support face 22*a*. In addition, in the heating unit 50C, at the second distance L2 (retracted position), as illustrated by a solid line in FIG. 9, the support face 22*a* is not directly irradiated with reflected light by the reflecting plate 572 via the first opening portion 511 and the second opening portion 512.

According to the present exemplary embodiment, similar effects to those of the first exemplary embodiment can be achieved, in addition, by the first opening portion 511 and the second opening portion 512 provided in the radiation plate 51C, the support face 22*a* of the transporting belt 22 is directly irradiated with direct light from the irradiation unit 571, thus the support face 22*a* can be efficiently heated. In addition, by directly radiating infrared light of the irradiation unit 571, compared to a case where the radiation plate is heated and the support face 22*a* is heated by radiant heat, energy saving can be achieved.

5. Modification 1

In the printing apparatus 100 of the first exemplary embodiment, the description has been given by illustrating the printing apparatus in which the adhesive layer 25 is formed at the support face 22*a* of the transporting belt 22, and printing of an image or the like is performed on the medium M such as fiber, that is, so-called textile printing is performed. However, the printing apparatus is not limited thereto, and the present disclosure may be applied to a printing apparatus in which the adhesive layer 25 is not formed at the support face 22*a* of the transporting belt 22, and a sheet as a medium is supported by a support face of a transporting belt and printing is performed. The same applies to the second exemplary embodiment through the fourth exemplary embodiment.

Note that, in the printing apparatus in which a sheet as a medium is supported by the support face, by installing a heating unit at a previous stage of a printing unit, the support face for the sheet of the transporting belt can be heated to heat the sheet supported by the support face before printing. Thus, drying of ink discharged during printing can be facilitated. Thus, immersion of the ink into the sheet can be suppressed, and fixing properties of the ink can be improved. In addition, in this case, the heating unit may be installed at a subsequent stage of the printing unit, and it is possible to facilitate evaporation of a solvent of the ink, and it is possible to prevent bleeding of the ink. In either case, in order for the support face not to be overheated to equal to or greater than an acceptable temperature, a control unit, when a condition is met, needs to cause the heating unit to move away from the support face such that a first distance is changed to a second distance.

Further, in the printing apparatus described above, when a cleaning unit for cleaning the transporting belt is provided, the support face after cleaning is dried by the heating unit at the first distance, and thus, for example, slipping of the sheet as the medium on the support face can be suppressed.

6. Modification 2

In the printing apparatus 100 of the first exemplary embodiment, the inner circumferential surface 51*a* of the radiation plate 51 in the heating unit 50 has the curved portion that is concentric with the support face 22*a*. However, the present disclosure is not limited thereto, and the radiation plate 51 need not be formed concentrically with the support face 22*a*, and it is sufficient that the radiation plate 51 is configured to face the support face 22*a*. The same applies to the second exemplary embodiment through the fourth exemplary embodiment.

7. Modification 3

In the printing apparatus 100 of the first exemplary embodiment, the plate member of aluminum is used as the radiation plate 51. However, the present disclosure is not limited thereto, and a metal member other than aluminum can be used to achieve a similar effect, as far as the metal member can emit radiant heat. The same applies to the second exemplary embodiment through the fourth exemplary embodiment.

8. Modification 4

In the printing apparatus 100 of the first exemplary embodiment, when the printing processing is ended and the transporting belt 22 is stopped, the distance from the support face 22*a* to the heating unit 50 is changed from the first distance L1 (heating position) to the second distance L2 (retracted position), with the power supply to the sheet-like heater 52 stopped. However, the present disclosure is not limited thereto, and when the transporting belt 22 is stopped, the heating unit 50 may maintain the state where the sheet-like heater 52 is powered when the heating unit 50 moves to the retracted position.

9. Modification 5

In the printing apparatus 100 of the first exemplary embodiment, when the heating unit 50 moves from the first distance L1 (heating position) to the second distance L2 (retracted position) by the adjustment mechanism 55, the moving is performed in two steps, and both the movements are performed linearly. However, the present disclosure is not limited thereto, and movement may be performed in a form including linear movement and rotational movement.

10. Modification 6

In the printing apparatus 100 of the first exemplary embodiment, when the heating unit 50 moves from the first distance L1 (heating position) to the second distance L2 (retracted position) by the adjustment mechanism 55, the moving is performed in two steps. That is, when the heating unit 50 is moved from the first distance L1 (heating position) to the second distance L2 (retracted position) by the adjustment mechanism 55, the movement is performed in at least two directions that intersect each other. However, the present disclosure is not limited thereto, the movement may be performed in one step. In other words, the movement may be performed only in one direction. In this case, in addition to the rotational movement as in the second exemplary embodiment, the movement may be performed linearly. Also, when the movement is performed in one step, the movement may be performed in a direction intersecting both the Y-axis and the Z-axis and along an X-Y plane.

11. Modification 7

The configurations of the adjustment mechanisms 55, 56, and 58 of the first to fourth exemplary embodiments are examples, and an adjustment mechanism using a configuration other than these adjustment mechanisms may be adopted. For example, a ball screw and motor may be combined. In other words, a mechanism is not limited to the adjustment mechanisms 55, 56, and 58 of the first to fourth exemplary embodiments, as long as the mechanism can change the distance from the support face 22*a* to the heating unit 50 from the first distance L1 (heating position) to the second distance L2 (retracted position). Furthermore, the adjustment mechanisms 55, 56, and 58 need not be controlled by the control unit 90. In this case, the condition causing the movement of the heating unit 50, such as the ending of the recording processing, need not be determined by the control unit 90. For example, the adjustment mechanisms 55, 56, and 58 may each include a handle that is graspable by a user and a coupling mechanism that couples the handle to the heating unit 50, the user may determine the condition such as the ending of the recording processing, and the user may manipulate the handle such that the distance from the support face 22*a* to the heating unit 50 is changed from the first distance L1 (heating position) to the second distance L2 (retracted position).

12. Modification 8

In the printing apparatus 100 of the first exemplary embodiment, when the printing processing is started, the heating unit 50 is simultaneously driven. However, the present disclosure is not limited thereto, and when the printing processing is started, the heating unit 50 may be driven with a small interval. The same applies to the second exemplary embodiment through the fourth exemplary embodiment.

13. Modification 9

In the printing apparatus 100 of the first exemplary embodiment, when the printing processing is started, after the heating unit 50 is heated at the second distance L2 (retracted position), the distance from the support face 22*a* to the heating unit 50 is changed from the second distance L2 (retracted position) to the first distance L1 (heating position). However, the present disclosure is not limited thereto, and the heating unit 50 may be moved while being heated. In other words, it is sufficient that the heating unit 50 is heated at any timing while the heating unit 50 reaches the heating position from the retracted position. The same applies to the second exemplary embodiment through the fourth exemplary embodiment.

14. Modification 10

In the printing apparatus 100 of the first exemplary embodiment, the support face 22*a* and the radiation plate 51 are separated by the first distance L1. However, this is because the adhesive layer 25 is provided at the support face 22*a*. However, the present disclosure is not limited thereto, and when a support face is not provided at an adhesive layer, the support face may contact the support face, in other words, the support face may slide in contact with the radiation plate, to heat the support face.

15. Modification 11

In the printing apparatus 100 of the first exemplary embodiment, the heating unit 50 is installed at the position facing the support face 22*a* (front surface) of the transporting belt 22. However, the present disclosure is not limited thereto, and in a case of a transporting belt that does not include the adhesive layer 25, a heating unit may be installed so as to face a back surface of the transporting belt (the inner circumferential surface 22*b* of the transporting belt 22 in the first exemplary embodiment). Note that, in such a configuration, heating is performed at or below an allowable temperature of the transporting belt. In this case, a method of movement from the first distance L1 to the second distance L2 may be movement in a width direction corresponding to the X direction.

16. Modification 12

In the printing apparatus 100 of the first exemplary embodiment, the heating unit 50 is installed at the position facing the support face 22*a* (front surface) of the transporting belt 22. However, the present disclosure is not limited thereto, and structure may be adopted in which a platen is provided at a position facing the discharge head 31 with the transporting belt 22 interposed, and a configuration may be adopted in which the platen is installed as a heating unit for performing heating.

17. Modification 13

In the heating unit 50 of the first exemplary embodiment, the sheet-like heater 52 is used, and in the heating unit 50B of the third exemplary embodiment, the heater 57 that emits infrared light is used. However, the present disclosure is not limited thereto, and a fan that blows hot air onto the support face 22*a* may be used.

18. Modification 14

In the printing unit 30 of the first exemplary embodiment, the serial head type is used in which the discharge head 31 is mounted on the carriage 32, and discharges ink while moving in the width direction (X direction) of the medium M. However, the present disclosure is not limited thereto, and a line head type may be used in which a discharge head extends in the width direction (X direction) of the medium M and is fixedly disposed. The same applies to the second exemplary embodiment through the fourth exemplary embodiment.

What is claimed is:

1. A recording device, comprising:

a recording unit configured to perform recording on a medium;

a transporting belt having a support face configured to support the medium, and configured to transport the medium;

a heating unit configured to heat the support face; and an adjustment mechanism configured to adjust a distance between the support face and the heating unit to a first distance and to a second distance that is greater than the first distance, wherein the transporting belt has an inner circumferential surface that is configured to be in contact with a roller around which the transporting belt is wound, an adhesive is provided with the support face, the adjustment mechanism moves the heating unit away from the support face such that the distance is changed from the first distance to the second distance, the heating unit is disposed opposite the inner circumferential surface to the support face, and the heating unit does not contact the adhesive at either the first or the second distance such that the heating unit heats the adhesive in a non-contact manner.

2. The recording device according to claim 1, comprising:

a cleaning unit configured to clean the support face with a cleaning liquid, wherein the heating unit heats, at the first distance, the support face cleaned by the cleaning unit, before the medium is supported.

3. The recording device according to claim 1, comprising:

a control unit configured to control the adjustment mechanism, wherein the control unit, when a condition is met, controls the adjustment mechanism, to move the heating unit away from the support face such that the distance is changed from the first distance to the second distance.

4. The recording device according to claim 3, wherein the condition includes ending of recording processing by the recording unit.

5. The recording device according to claim 4, wherein when the recording processing by the recording unit is started, the control unit moves the heating unit toward the support face such that the distance is changed from the second distance to the first distance.

6. The recording device according to claim 5, wherein when the recording processing is started, the control unit drives the heating unit and, after the heating unit reaches a predetermined temperature, moves the heating unit such that the second distance is changed to the first distance.

7. The recording device according to claim 1, wherein the heating unit includes a radiation plate, and the radiation plate is disposed facing the support face.

8. The recording device according to claim 7, wherein the radiation plate includes a plate member of aluminum.

9. The recording device according to claim 7, wherein the radiation plate has a curved portion facing a portion of the transporting belt, the portion is wound around the roller.

* * * * *